US007594908B2

(12) United States Patent
von Falkenhausen

(10) Patent No.: US 7,594,908 B2
(45) Date of Patent: Sep. 29, 2009

(54) PRIMARY PACKAGING USED AS AN APPLICATOR

(75) Inventor: Christian von Falkenhausen, Meckenheim (DE)

(73) Assignee: LTS Lohmann Therapie-Systeme AG, Andernach (DE)

( * ) Notice: Subject to any disclaimer, the term of this patent is extended or adjusted under 35 U.S.C. 154(b) by 378 days.

(21) Appl. No.: 10/546,013

(22) PCT Filed: Jan. 29, 2004

(86) PCT No.: PCT/EP2004/000767

§ 371 (c)(1),
(2), (4) Date: Aug. 18, 2005

(87) PCT Pub. No.: WO2004/074131

PCT Pub. Date: Sep. 2, 2004

(65) Prior Publication Data

US 2006/0200098 A1 Sep. 7, 2006

(30) Foreign Application Priority Data

Feb. 22, 2003 (DE) ..... 103 07 583

(51) Int. Cl.
*A61B 19/00* (2006.01)

(52) U.S. Cl. ..... 604/410; 604/403

(58) Field of Classification Search ..... 604/403, 604/408, 410; 206/438, 738, 739; 383/207
See application file for complete search history.

(56) References Cited

U.S. PATENT DOCUMENTS 2,997,770 A 6/1958 Ladd
3,342,326 A * 9/1967 Zackheim ..... 222/211
3,507,087 A 4/1970 Pratt
4,150,744 A * 4/1979 Fennimore ..... 206/205
5,389,686 A * 2/1995 Diop et al. ..... 514/651
5,971,971 A 10/1999 Saint-Ramon et al.
7,329,240 B2 * 2/2008 Mesa et al. ..... 604/138
2005/0017018 A1 1/2005 Von Falkenhausen et al.

FOREIGN PATENT DOCUMENTS

DE 44 12 754 C2 9/1999

(Continued)

*Primary Examiner*—Leslie R Deak
(74) *Attorney, Agent, or Firm*—Frommer Lawrence & Haug LLP

(57) ABSTRACT

Disclosed is a foil pocket (10) comprising at least one carrier foil (11) and at least one lidding foil (12). A foil-type or sheet-type product (1) is enclosed in a gas-tight and moisture-proof manner between the carrier foil (11) and the lidding foil (12), i.e. the joined parts, and is surrounded by a joining zone (30). At least one joining zone section (33, 34, 43, 44) which is not disposed perpendicular to the tear-off peeling direction (9) and is located laterally next to the product (1) widens and/or narrows in the joining zone (30) transversal to the tear-off peeling direction (9). At least the first quarter of the joining zone section (13, 43) that is not disposed perpendicular to the tear-off peeling direction (9) is provided with no widened area (35-41) and/or no narrow area (55-58). The invention make it possible to create a primary packaging which dispenses with the use of auxiliary means such as gloves, tweezers, or similar for applying systems containing active substances.

19 Claims, 4 Drawing Sheets

FOREIGN PATENT DOCUMENTS

| | | | |
|---|---|---|---|
| DE | 198 17 203 | A1 | 10/1999 |
| DE | 101 59 746 | A1 | 6/2003 |
| EP | 0 242 628 | A2 | 3/1987 |
| EP | 0 363 272 | A1 | 10/1989 |
| EP | 1 120 355 | A1 | 6/1999 |
| JP | 03-111267 | | 5/1991 |
| JP | 2000335574 | | 12/2000 |
| WO | WO 98/56686 | | 10/1998 |

* cited by examiner

PRIMARY PACKAGING USED AS AN APPLICATOR

The invention relates to a foil pocket comprising at least one carrier foil and at least one covering foil, a foil or sheet product being enclosed in a gas-tight and moisture-tight manner between the carrier foil and the covering foil, i.e. the joined parts, and the strength of the connection in the joining zone being lower than the strength of the joined parts.

DE 101 59 746 discloses a foil pocket of this type as primary packaging. This foil pocket is also used to keep foil or sheet products. However, here the foil pockets are stored packed in secondary packaging. The foil or sheet products are provided via a manually actuated mechanism integrated into the secondary packaging. If one were to open an individual foil pocket by simply tearing it open, that is to say without the aid of the secondary packaging, the packaged product would be separated in a largely uncontrolled manner from the parts of the foil pocket. As a result, it would then be necessary to grip the product by touching it, in order then to apply it at the respective intended location.

In particular in the veterinary medical sector, flat forms of a medicament, such as muco-adhesive systems, have to be applied to a tissue surface such as the mucous membrane. In this case, the user should avoid direct contact of his own skin with the corresponding form of the medicament since, under certain circumstances, the active substances integrated there, which are often highly powerful, represent a hazard for him himself. Here, as a rule, it is necessary to work with gloves. However, from specific points of view of the user, this appears complicated and inconvenient.

The present invention is therefore based on the problem of developing a foil pocket for foil or sheet products which renders superfluous the use of aids such as gloves, forceps or the like for the application of systems containing active substances.

This problem is solved with the features of the main claim. For this purpose, at least one joining-zone section, which is not arranged transversely with respect to the tear-off peeling direction and is located laterally beside the product, widens and/or narrows, at least in some sections, transversely with respect to the tear-off peeling direction. In this case, at least one additional joining zone placed at a short distance from the corresponding joining-zone section also counts as a widening. At least the first quarter of the joining-zone section which is not arranged transversely with respect to the tear-off peeling direction has no widening and/or narrowing.

In this primary packaging, an flat medicament or the product is enclosed between two foils, the closure-like joining zone between the foils being designed such that it can be torn open, for example by means of a peeling movement. In a region behind the front edge and in front of the rear edge of the packaged medicament, the joining zone has a widening or a narrowing or a combination of these width changes. This width change constitutes a disruption in the form of an at least brief change in the tear-off force required during the tear-off peeling movement. Because of this disruption, the user recognizes that he has torn open one third, half or two thirds, for example, of the packaging, depending on the location of the width change.

For the purpose of application, the packaging now partially torn open is held in the subregion which has not yet been torn open, for example between thumb and index finger. In this case, for example the region of the covering foil which has been peeled open rests folded back on the subregion of the packaging which has not been torn open. The thumb presses it against the subregion of the packaging which is still closed.

With the exposed subregion in front, the foil pocket is brought up to the point on the recipient at which it is to be applied. After the first contact with this point, the foil pocket is pressed on. In this case, the tip of the index finger presses the exposed region of the product against the application point via the substantially unbent carrier foil. As a result of the immediate adhesion of the product at this point, when the foil pocket is pulled away, emptying in the process, the product remains at the envisaged location.

Of course, even while the foil pocket is being pressed on, the covering foil can be pulled off completely before the foil pocket, now torn open along the entire length, is removed.

In both cases, the index finger of the user pressing the product onto the application point does not come into contact with the product.

Further details of the invention emerge from the subclaims and the following description of exemplary embodiments, illustrated schematically.

Figure 1:
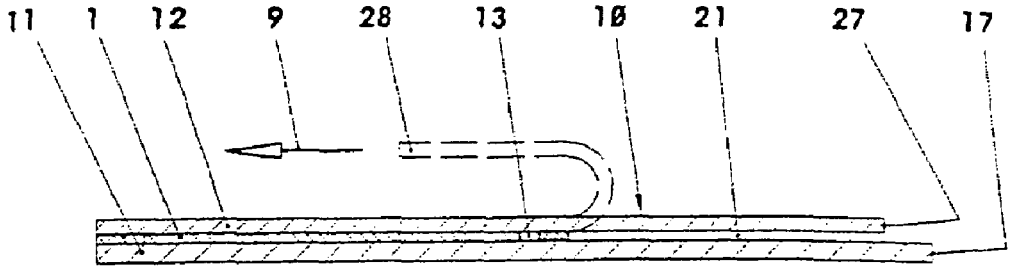
FIG. 1 shows a foil pocket in longitudinal section.
Figure 2:
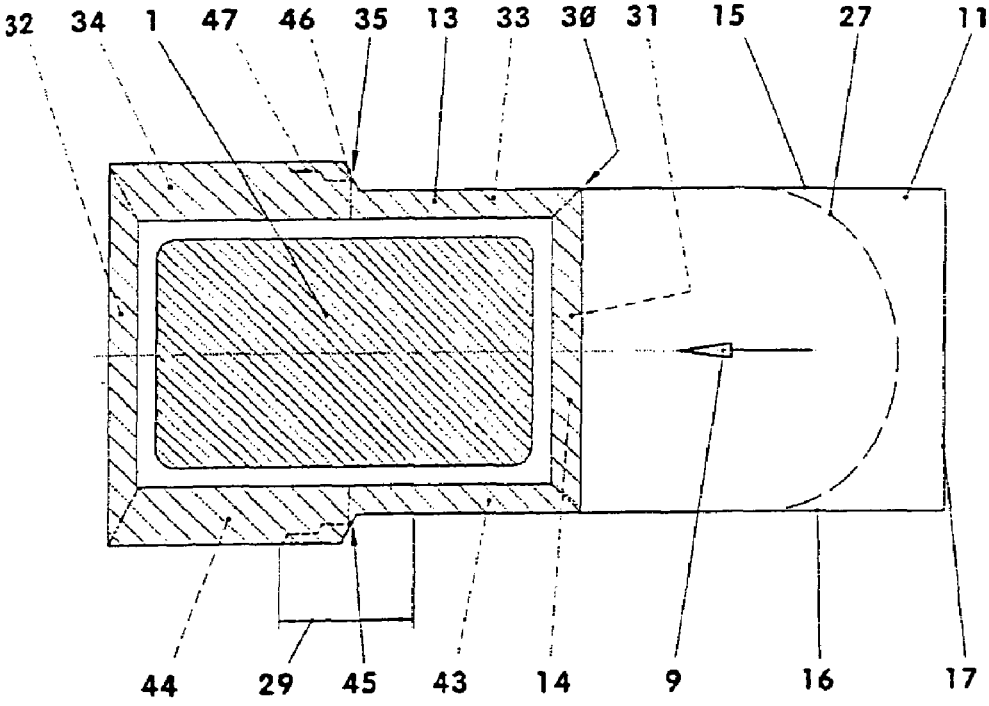
FIG. 2 shows a plan view of FIG. 1 without covering foil.

FIGS. 1 and 2 show a foil pocket (10) having an inserted foil or sheet product (1). The latter is, for example, a film, which can contain a pharmaceutical active substance, for example a selective analgesic. The foil pocket (10) is also designated primary packaging.

The foil pocket (10) comprises two foils, for example, between which the film-like product (1) is inserted over its entire area. Around the film (1), the two foils (11, 12) are adhesively bonded, sealed, welded or the like at a short distance from the edges of the film. Consequently, the film (1) is located in a gas-tight and moisture-tight hollow space. In the exemplary embodiment, for reasons of simplicity, the foils (11, 12) are connected to each other by means of an applied adhesive (13), purely by way of example.

The substances of which the foil pocket parts are produced are, for example, polyethylene (PE), polyethylene terephthalate (PET), fluorinated hydrocarbons such as Aclar, polypropylene (PP), OPA, polyacrylate (PA), EVOH, ethylene vinyl acetate copolymers (EVA), EC, Barex, Surlyn, paper, aluminum and appropriate combinations of these substances. These and comparable substances are used, amongst other things, for sealed bags and blister packages. In order to make the application easier by means of visual inspection, the foils can be designed to be at least partly transparent.

The foils (11) and (12) can also in each case be built up as composite materials from two or more layers of the aforementioned materials and, if appropriate, further materials.

They carrier foil (11) is a substantially rectangular foil, whose length corresponds, for example, to twice its width. In FIGS. 2-11, the carrier foil (11) is widened on both sides by approximately the width of the adhesive strip. The film (1) is laid on the carrier foil (11). Around the film (1), the carrier foil (11) is printed with adhesive (13), for example in the form of a strip. In this case, the adhesive (13) does not come into contact with the film (1). The covering foil (12)—illustrated dashed in FIG. 2—is placed in a firmly held manner on the film (1) and the adhesive (13). The strength of the connection in the joining zone (30) is always lower than the strength of the joined parts (11, 12), in order that the foil pocket (10), when opened, tears open in an exclusively controllable manner along the joining zone (30).

Here, the covering foil (12) has the same width dimensions as the carrier foil (11). However, it is shorter. Its front edge (27), which is semielliptical, for example, is offset rearward, for example by a few millimeters. Between the front edge (27) and the front section (31) of the adhesive (13) there is a gap (21) of about one third of the length, cf. FIG. 1. In this region, the foils (11, 12) do not adhere to each other.

As an alternative to the foil pocket (10) illustrated in FIG. 1, the primary packaging can also comprise foils which have a depression in the contact region with the filling (1). A depression in only one of the foils is also conceivable. The corresponding foil is designed as a thermoformed blister base. In both cases, the edge regions of the foils then rest on each other over the entire area, in spite of the inserted product (1), so that the height of the gap (21) becomes virtually infinitely small.

In a further alternative, the carrier foil (11) and the covering foil (12) comprise a strip which, when the product (1) is packaged, is folded together in such a way that sealing or adhesive bonding at the rear edge of the foil pocket is dispensed with.

The geometric external contour of the foil pockets (10), inter alia predefined by the edges (15-17), cf. FIG. 2, is largely rectangular purely by way of example. Of course, the foil pocket (10) can also have a polygonal, round, elliptical, oval or any other conceivable contour in plan view, provided that it is suitable for the foils (11, 12) to be separated by a tear-open peeling movement.

In order, when the foil pocket (10) is torn open, that is to say when the covering foil (12) is torn mechanically off the carrier foil (11), not to involve the risk of separating the two foils (11, 12) with a jolt—with the uncontrolled detachment of the packaged product (1)—after at least one quarter of the product length, for example on both sides of the product (1), the adhesion between the foils is increased abruptly. For this purpose, the joining zone (30) is widened, at least in some regions. FIGS. 2-8 show various widening possibilities.

A joining zone (30) is illustrated in plan view in FIG. 2. It encloses the product completely, as do also the joining zones of the other FIGS. 3-11. The joining zone (30) here consists of a front (31), a rear (32) and four lateral joining zone sections (33, 34; 43, 44). The sections (33, 34; 43, 44) are here arranged parallel to the tear-off peeling direction (9), while the sections (31) and (32) run transversely with respect to this direction. These sections (31-33, 43) have a constant width of, for example, about 3 mm. Depending on the size and type of the foil pockets and the type of connection between the foils (11, 12), the width can fluctuate between 1 and 10 millimeters.

The sections (34) and (44) have, according to FIG. 2, twice the width of the sections (31-33, 43). Approximately at half the length of the product (1), the joining zone (30) in the central region (29) changes the width on both sides at the widenings (35) and (45). At the points (35) and (45), in the example illustrated, the necessary tear-open force increases abruptly to at least twice the value as the foil pocket (10) is torn open. In the sections (33) and (43), the necessary tear-open force, given the predefined geometric dimensions, is for example about 0.4 N. This value increases in the sections (34) and (44), for example to 1.4 N. This change in the force can be detected or felt clearly during manual opening by separating the foils (11, 12) by peeling. Instead of the widening, the adjoining zone can also be double-sealed in order to increase the tear-open force, that is to say, for example, a subregion of the joining zone is sealed twice or repeatedly. In the case of adhesive bonding of the foils (11) and (12), another adhesive with a higher bonding strength can be used to some extent within the joining zone.

The widening of the sections (34) and (44) extends outward transversely with respect to the tear-open direction (9). The outer transition from the section (33, 43) to the section (34, 44) is made via a chamfer (46). The chamfer (46), which widens toward the end of the foil pocket (10), forms a 60° angle with the tear-off direction (9). If appropriate, the outer transition can be configured in the manner of a staircase, in order to achieve a stepped increase in the necessary tear-open force, cf. the dashed line (47) between the sections (33, 43) and (34, 44).

In FIGS. 3-11, only one half side of the foil pockets is illustrated.

Figure 3:
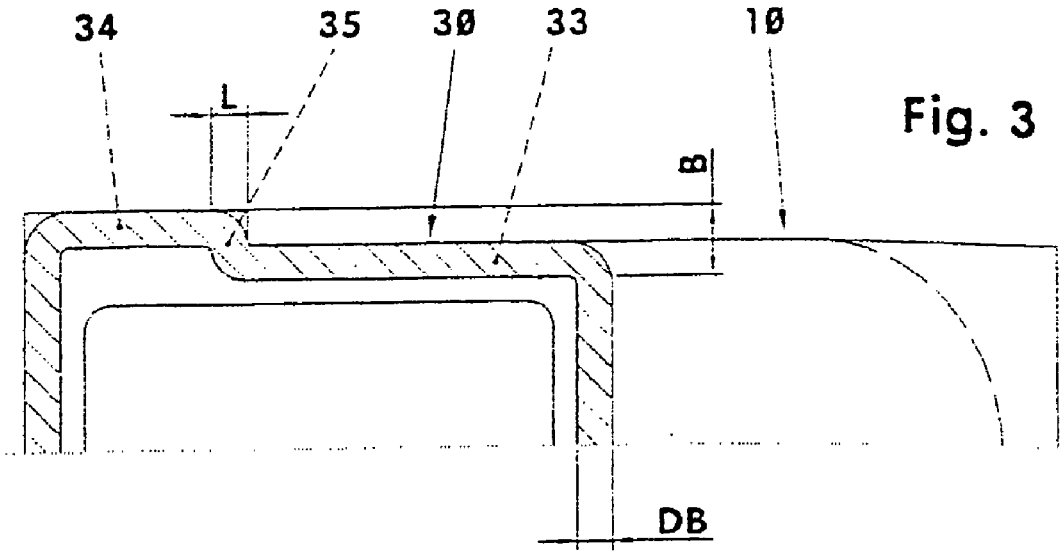
FIG. 3 shows a half plan view without covering foil but with a largely equally wide joining zone.
Figure 4:
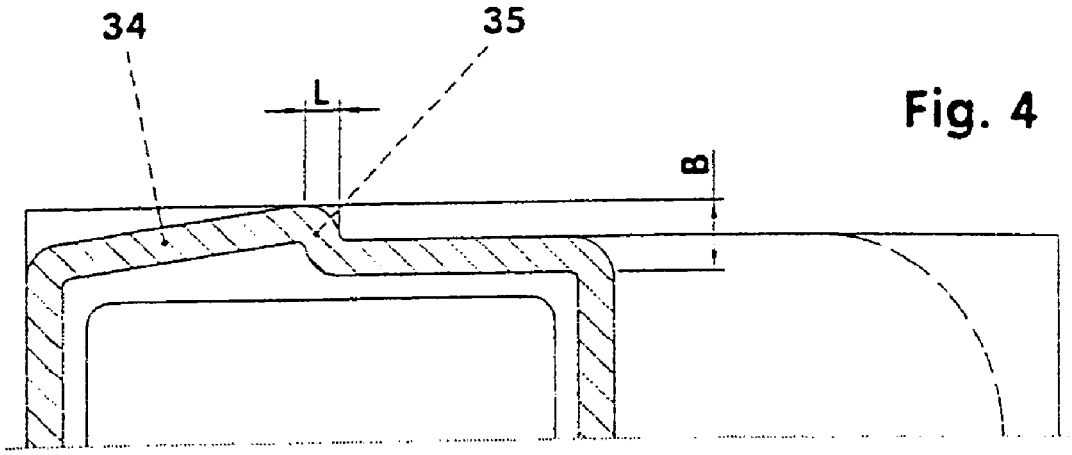
FIG. 4 is like FIG. 3 but with a different course of the joining zone.

FIGS. 3 and 4 show foil pockets (10) having joining zones (30) which have an at least approximately constant average width (DB) over their entire extent. Between the sections (33) and (34) there is a double angled portion (35), which has a width (B) transversely with respect to the tear-open direction (9). It has a length (L) parallel to the tear-open direction. The length (L) corresponds to the average width of the joining zone (30). The double angled portion (35) is configured here, by way of example, such that the section (34) is offset by the average width (DB) with respect to the section (33). This offset can also lie between half and three times the average width (DB).

In FIG. 3, the sections (33, 34) are offset parallel to each other, while in FIG. 4 they form an acute angle.

Figure 5:
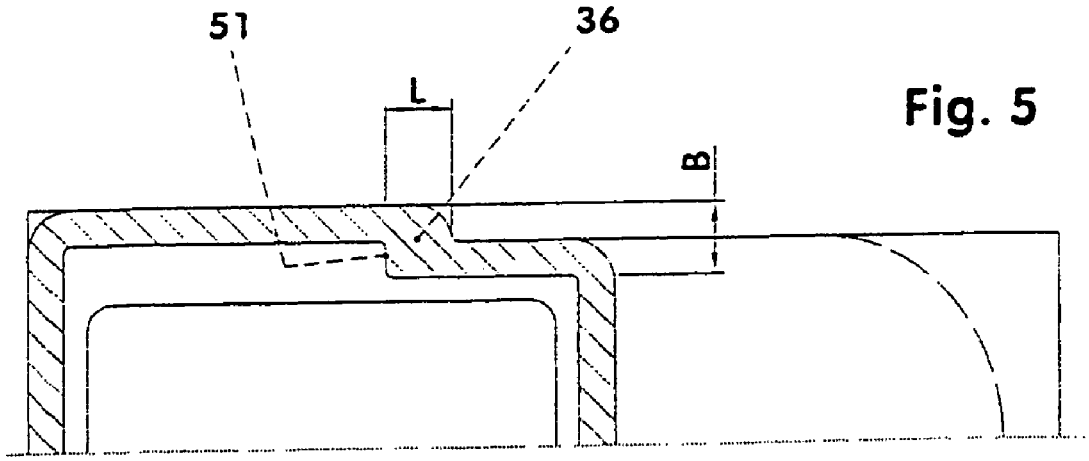
FIG. 5 is like FIG. 3 but with a joining-zone widening which is longer in some sections.
Figure 6:
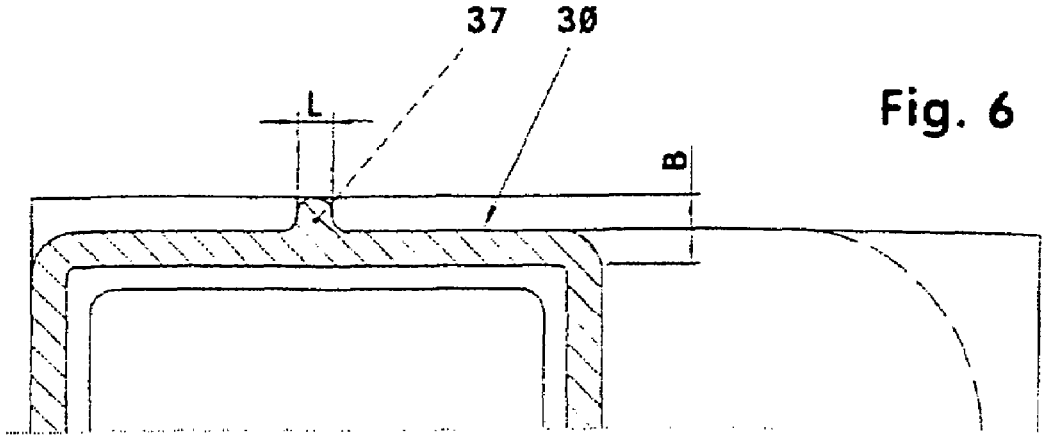
FIG. 6 is like FIG. 3 but with a widening which is not angled over.

In FIG. 5, a joining zone (30) is illustrated whose double angled portion (36) has a length (L) which is greater than the average width (DB). Here, the length (L) corresponds to twice the average width (DB), for example.

FIGS. 6-11 show joining zones (30) which, in the exemplary embodiment, surround the product (1) as a largely rectangular frame, without a double angled portion (35). According to FIG. 6, the joining zone (30) is widened in the central region (29), cf. FIG. 2, between the sections (33, 34). The widening (37) projects outward, for example at right angles and in the form of a web, beyond the outer edge of the sections (33, 34). The projection here corresponds, for example, to the average width (DB). Of course, the widening (37) can also project inward, toward the product. In addition, the widening can extend on both sides of the edges of the sections (33, 34), for example like a circular widening which is located centrally on the joining zone (30) in the region (29) and whose diameter corresponds, for example, to twice the average width (DB).

Figure 7:
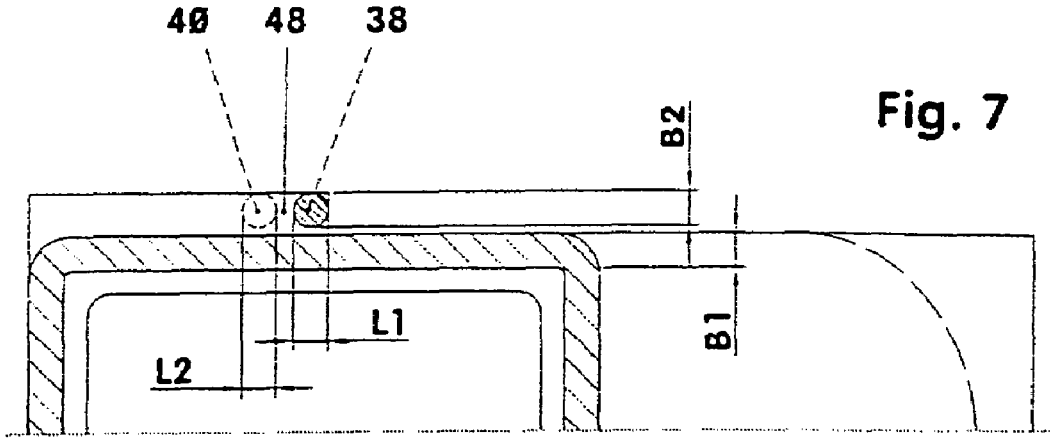
FIG. 7 is like FIG. 6 but with at least one additional joining zone.
Figure 8:
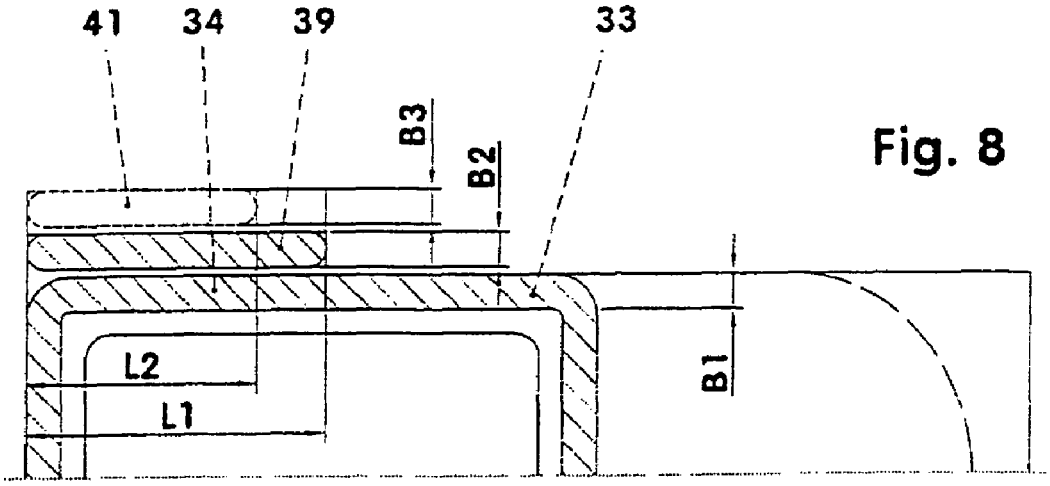
FIG. 8 is like FIG. 7 but with at least one elongated additional joining zone.

In FIGS. 7 and 8, the widenings are formed as additional joining zones (38) and (39). According to FIG. 7, the additional joining zone (38) is, for example, a central area having a diameter which corresponds to the average width (DB). It is arranged in the central region (29), cf. FIG. 2, outside the joining zone (30). The minimum distance between the joining zone (30) and the circular additional joining area (38) is one fifth of the average width (DB). The sum of the widths (B1) and (B2) constitutes the total widening.

Of course, the additional joining zone (38, 39) can be produced by a different method than the regular joining zone (30). For example, the joining zone (30) can be produced by sealing, while the additional joining zones (38, 39) are produced by applying an adhesive which bonds physically or chemically.

In the tear-open direction (9) or at least approximately in this direction, there can also be arranged a plurality of additional joining zones (40) of the same or different form, see FIG. 7. There, a dashed, unhatched circle (40) is illustrated as a further additional joining zone. When the foil pocket (10) having two additional joining zones (38) and (40) which are separated from each other is torn open, the person tearing it open is additionally conscious of a jolt, which arises as a result of the brief reduction in the tear-open force in the gap (48) between the two additional joining zones (38, 40). The gap (48) has, for example, a minimum length which corresponds to half the average width (DB).

FIG. 8 shows as an additional joining zone (39) an adhesively bonding or sealing strip which, for example as what is known as a double seal, is oriented parallel to the section (34). The distance between the section (34) and the additional joining zone (39) is one fifth of the average width (DB). In a further variant of the solution, an additional joining zone (41), for example a shorter one, can additionally be arranged, for example beside the area (39) or the section (34).

Figure 9:
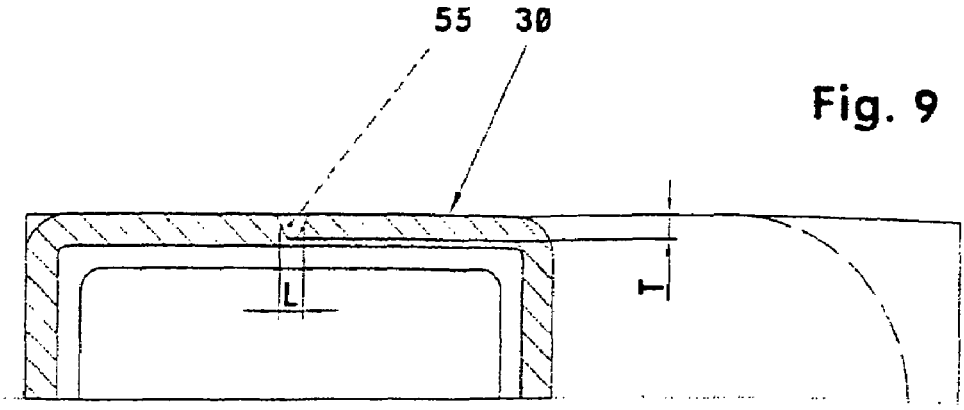
FIG. 9 shows a joining zone with an outer notch as a narrowing.
Figure 10:
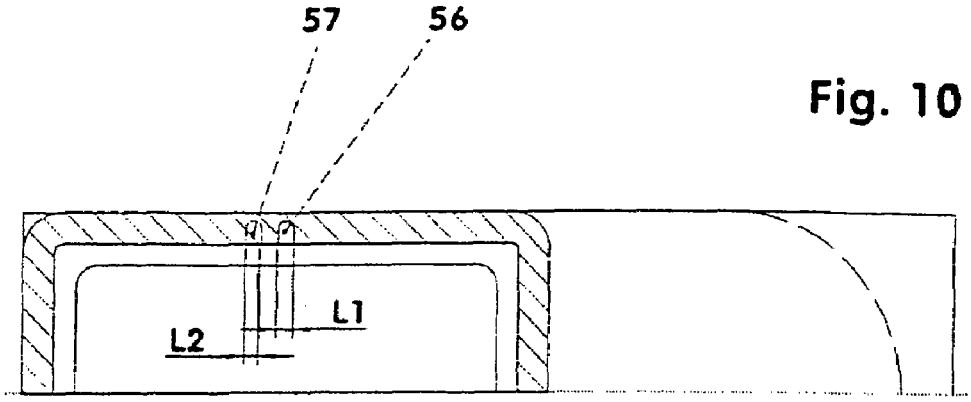
FIG. 10 shows a joining zone having at least one inner notch.
Figure 11:
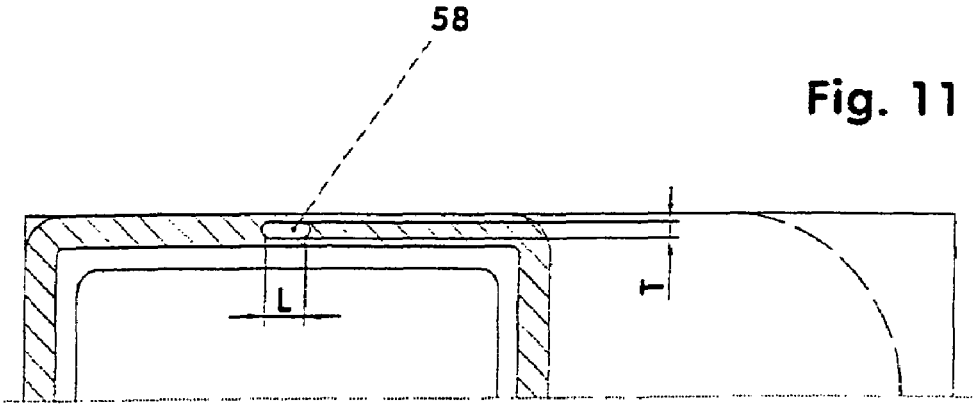
FIG. 11 shows a joining zone having a cutout.

FIGS. 9-11 show joining zones (30) in which the deliberate disruption during the tear-open operation is caused by a reduction in the joining zone width. In FIG. 9, the narrowing is produced by a notch (55). The notch (55), which projects into the joining zone (30) from outside, has, for example, an approximately semi-circular groove base and two flanks leading away from the base of the notch in a v shape. In the region of the notch (55), the joining zone (30) is reduced, for example, to one quarter of the average width (DB).

In FIG. 10, an inwardly oriented notch (56) is located in the region illustrated. Said notch has, for example, straight flanks which are oriented transversely with respect to the tear-open direction (9).

In FIG. 11, a joining zone (30) is shown in which the narrowing is produced by a cutout (58). The cutout (58) which, for example, has the form of a slot, has a length which corresponds, for example, to the average width (DB). The width of the slot is chosen such that the remaining width of the joining zone (30) is about 50% of the average width.

List Of Designations:

1 Film or sheet product, film
9 Tear-open peeling direction
10 Foil pocket, primary packaging
11 Carrier foil, joined parts
12 Covering foil, joined parts
13 Adhesive
14 Front section of (13)
15, 16 Lateral edges of (11)
17 Front edge of (11)
21 Gap
27 Front edge of (12)
28 Covering foil in pull-off position
29 Central region
30 Joining zone, adhesive area, sealing area, sealed seam
31 Front joining-zone section, transverse with respect to (9)
32 Rear joining-zone section, transverse with respect to (9)
33 Front joining-zone section, not transverse with respect to (9)
34 Rear joining-zone section, not transverse with respect to (9)
35 Widening, double angled portion
36 Long widening
37 Protruding, projecting widening
38 Additional joining zone, short and possibly multi-part
39 Additional joining zone, long
40 Additional joining zone, circular
41 Additional joining zone, medium long
43 Front joining-zone section, not transverse with respect to (9)
44 Rear joining-zone section, not transverse with respect to (9)
45 Widening, double angled portion
46, 47 Widening contour, contour
48 Gap
51 Rear edge of (36)
55 Narrowing from the outside; notch
56, 57 Narrowing from the inside; notch
58 Narrowing, cutout enclosed by joining zone
B, B1 Width of the joining zone
B2 Width of the additional joining zone
DB Average width of the joining zone
L Length of the widening
L1, L2 Lengths in the event of a plurality of widenings
T Depth of the narrowing, measured transversely with respect to (9)

The invention claimed is:

1. A foil pocket (10) comprising
at least one carrier foil (11),
at least one covering foil (12), and
a foil or sheet product (1) containing a pharmaceutically active substance, for adhering to a tissue surface, being enclosed in a gas-tight and moisture-tight manner by the carrier foil (11) and the covering foil (12),
wherein:
the contact between the carrier foil (11) and the covering foil (12) forms a joining zone (30), and the strength of the connection in the joining zone (30) being lower than the strength of the carrier foil (11) and covering foil (12)
at least one joining-zone section (33, 34; 43, 44), which is not arranged transversely with respect to the tear-open peeling direction (9), is located laterally beside the product (1), narrows or widens transversely with respect to the tear-open peeling direction (9), at least in some sections, at least one additional joining zone (38-41) placed at a short distance from the corresponding joining-zone section (34, 44) also counting as a widening,
at least the first quarter of the joining-zone section (33, 43) which is not arranged transversely with respect to the tear-open peeling direction (9) has no widening (35-41) or narrowing (55-58); and
wherein when the at least one joining zone-section (33, 34; 43, 44) is torn open by a person in the tear-open peeling direction (9), the foil or sheet product (1) adheres to the tissue surface at an application point and does not contact the person outside the application point; and
wherein the width of the joining zone (30) is narrowed and contains:
i. a notch (55) which projects into the joining zone (30) from the outside of the foil pocket (10); or
ii. a notch (56) which projects into the joining zone (30) from the inside of the foil pocket (10); or
iii. a cutout (58) in the form of a slot which has a length which corresponds to the average width of the joining zone (30).

2. The foil pocket as claimed in claim 1, characterized in that when the at least one joining-zone section (33, 34; 43, 44) widens transversely with respect to the tear-open peeling direction (9), the length (L, L1, L2) of the widening (35-41) measured in the tear-open peeling direction (9) is of at least the average width (DB) of the joining-zone sections (31-33; 43) located outside the widening (35-41).

3. The foil pocket as claimed in claim 1, characterized in that the widenings (35-41) and/or the narrowings (55-58) begin at least in the central region (29) of the product (1), measured in the tear-open peeling direction (9).

4. The foil pocket as claimed in claim 1, characterized in that the joining zone (30) and the additional adjoining zones (38-41) are sealing seams.

5. The foil pocket as claimed in claim 1, characterized in that the central third of the longitudinal extent of the product (1) is in the central region (29), in which the widenings (35-41) and/or the narrowing (55-58) begin.

6. The foil pocket as claimed in claim 1, characterized in that the widening (35-41) has a width (B, B1+B2; B1+B2+B3) measured transversely with respect to the tear-open peeling direction (9) which is between 50 and 400% of the average width of the joining-zone sections (31-33; 43) located outside the widening (35-41).

7. The foil pocket as claimed in claim 1, characterized in that the individual narrowing (35-41) has a width (T) measured transversely with respect to the tear-open peeling direction (9) which is between 25 and 90% of the average width of the joining-zone sections (31-33; 43) located outside the narrowing (35-41).

8. The foil pocket as claimed in claim 1, characterized in that the widening (35) and/or the narrowing (55) has a stepped contour (47).

9. The foil pocket as claimed in claim 1, characterized in that when the at least one joining-zone section (33, 34; 43, 44) narrows transversely with respect to the tear-open peeling direction (9), the average length (L, L1, L2) of the narrowing (55-58) measured in the tear-open peeling direction (9) is of at least one third of the average width (DB) of the joining- zone sections (31-33; 43) located outside the widening (35-41).

10. The foil pocket as claimed in claim 9, characterized in that the widenings (35-41) and/or the narrowings (55-58) begin at least in the central region (29) of the product (1), measured in the tear-open peeling direction (9).

11. The foil pocket as claimed in claim 10, characterized in that the joining zone (30) and the additional adjoining zones (38-41) are sealing seams.

12. The foil pocket as claimed in claim 11, characterized in that the central third of the longitudinal extent of the product (1) is in the central region (29), in which the widenings (35-41) and/or the narrowing (55-58) begin.

13. The foil pocket as claimed in claim 12, characterized in that the widening (35-41) has a width (B, B1+B2; B1+B2+B3) measured transversely with respect to the tear-open peeling direction (9) which is between 50 and 400% of the average width of the joining-zone sections (31-33; 43) located outside the widening (35-41).

14. The foil pocket as claimed in claim 13, characterized in that the individual narrowing (35-41) has a width (T) measured transversely with respect to the tear-open peeling direction (9) which is between 25 and 90% of the average width of the joining-zone sections (31-33; 43) located outside the narrowing (35-41).

15. The foil pocket as claimed in claim 14, characterized in that the widening (35) and/or the narrowing (55) has a stepped contour (47).

16. The foil pocket as claimed in claim 15, wherein the pharmaceutically active substance is a selective analgesic.

17. The foil pocket of claim 1, wherein the width of the joining zone (30) is narrowed by a notch (55) which projects into the joining zone (30) from the outside of the foil pocket (10) and the joining zone (30) is reduced to one quarter the average width of the joining zone (30).

18. The foil pocket of claim 1, wherein the width of the joining zone (30) is narrowed by a notch (56) which projects into the joining zone (30) from the inside of the foil pocket (10) wherein said notch (56) comprises of straight flanks which are oriented transversely with respect to the tear open direction (9).

19. The foil pocket of claim 1, wherein the width of the joining zone (30) is narrowed by a cutout (58) in the form of a slot which has a length which corresponds to the average width of the joining zone (30) wherein the remaining width of the joining zone (30) is about 50% of the average width of the joining zone (30).

* * * * *